US005517838A

United States Patent [19]

Moore

[11] Patent Number: 5,517,838

[45] Date of Patent: May 21, 1996

[54] PORTABLE PICK-PROOF DEADBOLT ATTACHMENT

[76] Inventor: Melinda A. Moore, 1162 Riverside Dr., Myrtle Creek, Oreg. 97457

[21] Appl. No.: 281,164

[22] Filed: Jul. 27, 1994

[51] Int. Cl.[6] ..... E05B 13/00

[52] U.S. Cl. ..... 70/416; 70/430; 70/14; 24/16 PB

[58] Field of Search ..... 70/14, 18, 19, 70/416, 419, 429, 430, 431, 447; 24/16 PB, 182, 197, 200, 306, 442

[56] References Cited

U.S. PATENT DOCUMENTS

| | | | |
|---|---|---|---|
| 619,035 | 2/1899 | Craddock | 70/430 |
| 1,074,359 | 9/1913 | Heimbaugh | 70/430 X |
| 1,384,497 | 7/1921 | Symons | 70/430 |
| 1,700,045 | 1/1925 | Hampton | 70/430 |
| 1,955,430 | 4/1934 | Lumb et al. | 70/65 |
| 1,956,542 | 4/1934 | Wilson | 70/65 |
| 2,463,195 | 3/1949 | Mungan | 70/416 |
| 2,641,812 | 6/1953 | Boudreau | 24/182 X |
| 3,585,827 | 6/1971 | Dominguez | 292/1 |
| 3,862,556 | 1/1975 | Moses | 70/416 |
| 4,279,137 | 7/1981 | Cook | 70/416 |
| 4,712,766 | 12/1987 | Ehrenhalt | 24/16 PB X |
| 4,715,200 | 12/1987 | Katsaros | 70/211 |
| 4,827,745 | 5/1989 | Baugh | 70/416 |
| 5,008,987 | 4/1991 | Armour, II | 24/306 X |
| 5,032,202 | 10/1991 | Murphy | 70/211 |
| 5,042,113 | 8/1991 | Severson et al. | 24/16 PB |
| 5,063,641 | 11/1991 | Chuan | 24/197 |
| 5,067,334 | 11/1991 | Sorkilmo | 70/416 |
| 5,136,759 | 8/1992 | Armour, II | 24/306 X |
| 5,177,986 | 1/1993 | Jensen | 70/18 |

FOREIGN PATENT DOCUMENTS

| | | | |
|---|---|---|---|
| 15009 | 11/1880 | Germany . | |
| 191952 | 10/1907 | Germany | 70/430 |
| 80935 | 4/1919 | Switzerland | 70/430 |
| 454672 | 11/1936 | United Kingdom . | |

*Primary Examiner*—Steven N. Meyers
*Assistant Examiner*—Suzanne L. Dino
*Attorney, Agent, or Firm*—Richard C. Litman

[57] ABSTRACT

A portable deadbolt lock security device is configured to prevent the handle of the deadbolt lock from being turned. The device includes a flexible strap having a first end, a second end, and a medial portion. An opening is located in the first end of the strap. A fastener is provided for mutually engaging the second end of the strap with the medial portion. In use, the handle of the deadbolt lock is turned to its locked position and inserted into the opening in the first end of the strap. Subsequently, the second end of the strap is encircled about the stem of a doorknob, pulled taut, and brought into mutual engagement with the medial portion of the strap.

8 Claims, 2 Drawing Sheets

PORTABLE PICK-PROOF DEADBOLT ATTACHMENT

BACKGROUND OF THE INVENTION

1. Field of the Invention

The present invention relates to a security device and more particularly, to a portable deadbolt lock security device configured to prevent a deadbolt lock from being operated exteriorly of a door.

2. Description of the Prior Art

Doors of houses and similar structures normally include a doorknob which is grasped and turned to control a locking mechanism between a locked and unlocked position, permit the door to be opened and closed, and further permit egress and ingress through the door opening.

Doorknobs have been found to be insufficient in preventing unauthorized entry. As a result, a secondary lock, commonly referred to as a deadbolt lock, has been used in conjunction with the doorknob. Deadbolt locks are generally operable exteriorly of the door via a key. Interiorly of the door, deadbolt locks are typically controlled by a key or by a handle which is rotatable between 90 and 180 degrees to lock and unlock the deadbolt lock locking mechanism.

Deadbolt locks may not provide sufficient protection in that they are vulnerable to being picked. Moreover, certain individuals may be provided with master keys configured to operate deadbolt locks. Furthermore, individuals may obtain keys in an unauthorized manner and which permit unauthorized control of deadbolt locks. A supplemental security device which permits an inhabitant to prevent the operation of deadbolt locks exteriorly of doors will provide greater peace of mind for the inhabitant.

In the past, many such devices have been provided to prevent the operation of deadbolt locks exteriorly of the door. Such devices are shown, for example, in U.S. Pat. No. 1,955,430, issued Apr. 17, 1934, to Isaac F. Lumb et al., and U.S. Pat. No. 1,956,542, issued Apr. 24, 1934, to Louis P. Wilson, disclosing key fasteners comprising a hook engaging a stem of a doorknob and an end opposite the hook which engages a key to prevent the key from turning. Another key fastener is disclosed in U.S. Pat. No. 4,827,745, issued May 9, 1989, to Benton F. Baugh, wherein the fastener includes a first member which fits of a deadbolt lock key, a second member which engages a doorknob, and a flexible link connecting the first member to the second member. The first member is also adaptable to engage a deadbolt lock handle.

A shield for a deadbolt lock handle is disclosed in U.S. Pat. No. 2,463,195, issued Mar. 1, 1949, to Paul F. Mungan. The shield has an elongated recess in an underside thereof for receiving an elongated deadbolt lock operator. A notched bar projecting from the shield engages a locking member to secure the stem of a doorknob.

A security lock is disclosed in U.S. Pat. No. 3,585,827, issued Jun. 22, 1971, to Domingo Dominguez, wherein the security lock includes a deadbolt lock handle retention member having an elongated forked member mounted thereto which fits about a portion of a doorknob.

U.S. Pat. No. 3,862,556, issued Jan. 28, 1975, to Adolph Moses, U.S. Pat. No. 4,279,137, issued Jul. 21, 1981, to Roy 0. Cook, and U.S. Pat. No. 5,032,202, issued Oct. 1, 1991, to Jerry A. Murphy, disclose brackets having one end configured to straddle the deadbolt lock handle and an opposite end which is bifurcated to receive the stem of a doorknob.

Another locking device is disclosed in U.S. Pat. No. 4,715,200, issued Dec. 29, 1987, to James Katsaros. This locking device has a bracket for tightly receiving a deadbolt lock handle and an elongated bar fixed to the bracket for abutting a doorknob.

A deadbolt lock security device is disclosed in U.S. Pat. No. 5,067,334, issued Nov. 26, 1991, to Clayton O. Sorkilmo. Sorkilmo discloses a deadbolt lock security device including two legs separated by a notch through which a deadbolt lock handle passes. The legs may be brought into binding engagement with the deadbolt lock handle to prevent the handle from rotating.

German Patent No. 15009, published Nov. 18, 1880, discloses a device for locking and unlocking door lock from a remote location. The device includes a right angled arm supported by a handle and having a slot therein for receiving and clamping upon a key.

Great Britain No. 454,672, published May 12, 1935, discloses a diametrically separable casing configured to enclose a deadbolt lock handle to prevent the actuation of the deadbolt lock.

Attempts to provide simple and inexpensive deadbolt lock security devices have been inadequate. In order to provide a simpler, more inexpensive device for preventing the operation of deadbolt locks exteriorly of a door than those disclosed in the above mentioned prior art, applicant has devised a deadbolt lock security device described hereinafter.

None of the above inventions and patents, taken either singly or in combination, is seen to describe the instant invention as claimed.

SUMMARY OF THE INVENTION

The present invention relates to a portable deadbolt lock security device. The device is comprised of a flexible strap having a reinforced slit. The reinforced slit is configured to receive the handle of a deadbolt lock. The strap includes a portion intended to be looped around a doorknob, pulled taut and secured to itself via a fastening device, such as a hook and loop type fastener. Other fasteners, such as snaps, pop-buttons, and the like, may be employed to secure the strap to itself.

Accordingly, it is a principal object of the invention to provide a device for restraining the rotation of a deadbolt lock handle so as prevent the unauthorized operation of a deadbolt lock exteriorly of a door.

It is another object that the device be simple to install and remove without marring the door, and requiring no installation hardware or equipment.

It is a further object that the device be a small and compact portable device capable of being easily transported and adapted to be readily used with various deadbolt lock configurations.

Still another object is that the portable deadbolt lock security device include a flexible strap having a reinforced slit therethrough configured to receive the handle of a deadbolt lock. A portion of the strap opposite the slit is intended to be looped around a doorknob, pulled taut, and secured to itself via a fastening device, thus preventing the deadbolt lock handle from being displaced exteriorly of a door.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
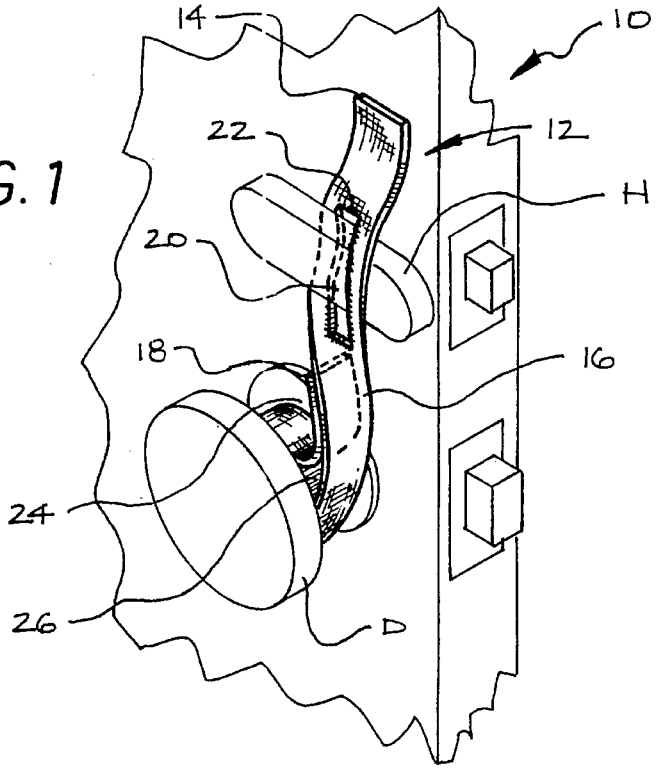
FIG. 1 is an environmental perspective view of a portable deadbolt lock security device according to the present invention.
Figure 2:
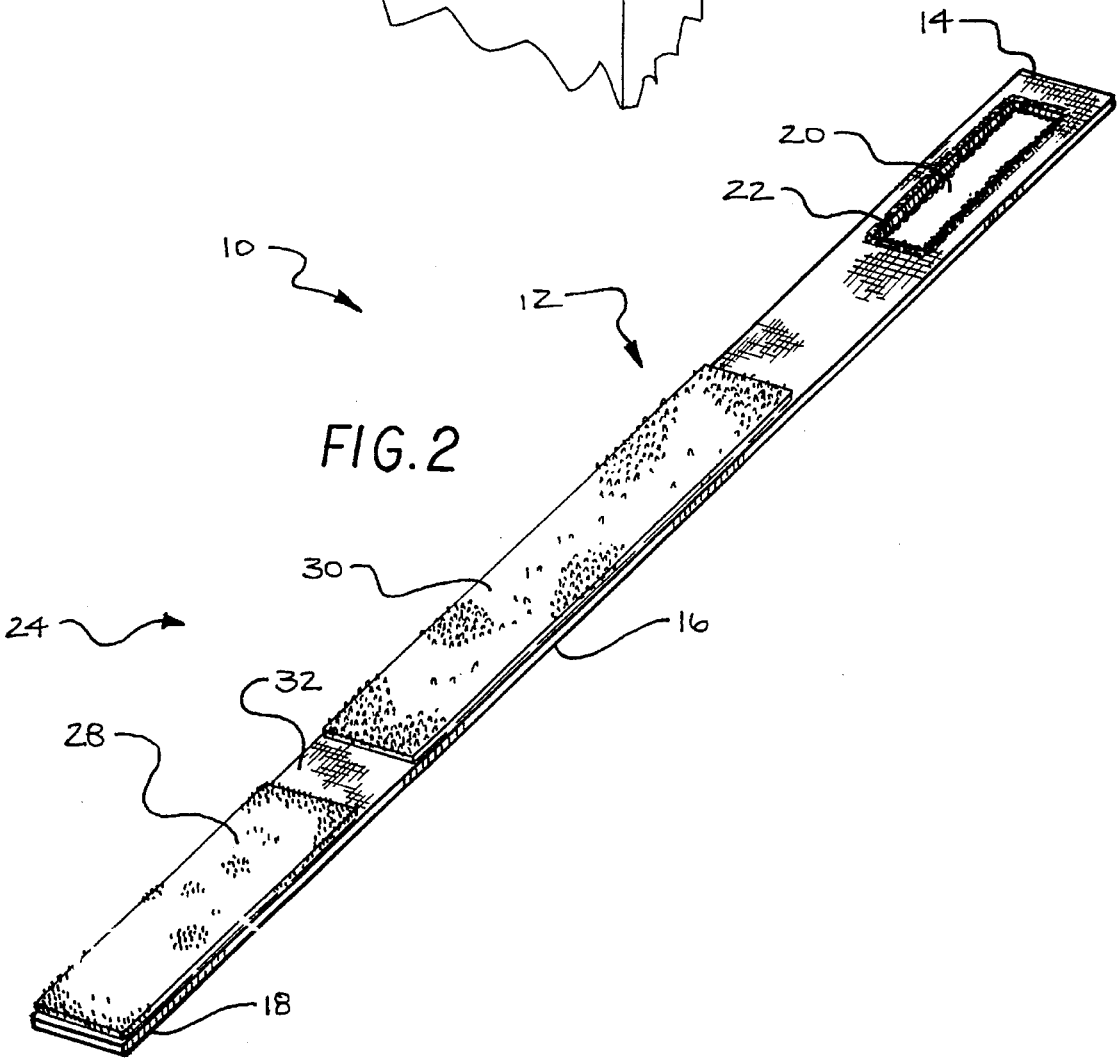
FIG. 2 is a perspective view of the portable deadbolt lock security device shown in FIG. 1.

The present invention, as shown in FIGS. 1 and 2, is a portable deadbolt lock security device 10 configured to prevent the handle H of a deadbolt lock from being turned exteriorly of a door. The device 10 includes a flexible strap 12 having a first end 14, a second end 18 opposite the first end 14, and a medial portion 16 intermediate the first and second ends 14 and 18. The strap 12 may be fabricated from a webbed material and more particularly, from a webbed material fabricated from a man made composition such as those of a nylon composition. This would provide a strong durable strap 12 of increased life expectancy. Alternatively, the strap 12 may be fabricated from a loop material forming part of a hook and loop type fastener 24, such as the fastener 24 heretofore described.

An opening 20 is defined by the first end 14 of the strap 12. The opening 20 is dimensioned to tightly receive the handle H of a deadbolt lock. The strap 12 may be provided with reenforced structure 22 about the opening 20 and which resists wear. The reenforced structure 22 may include stitching, such as button hole stitching, about the opening 20. The opening 20 may be a slot, such as that shown in the drawings, or may be in the form of a slit. A slit may provide a more restrictive opening 20 than a slot and thus, may hold a deadbolt lock handle H tighter than a slot.

A fastener 24, as previously mentioned, is provided for mutually engaging the second end 18 and the medial portion 16 of the strap 12. A variety of fasteners may be employed. For example, a hook and loop type fastener 24, as stated above, may be employed for securing the second end 18 of the strap 12 to the medial portion 16 to form a closed loop 26. The closed loop 26 may be adjusted by varying the engagement of the hook and loop material 28 and 30.

As shown, more particularly, in FIG. 2, an elongated strip of loop material 30 may be longitudinally attached to the medial potion 16 of the strap 12 and an elongated strip of hook material 28 may be longitudinally attached to the second end 18 of the strap 12. The strips of hook and loop material 28 and 30 may be attached to the same surface 32 of the strap 12 so as to permit the second end 18 to be folded against the medial portion 16 and thereby permit the hook and loop materials 28 and 30 to engage one another without twisting the strap 12.

It should be noted that a strap may be fabricated from a loop material 30, as described above, or loop material 30 may be attached to some portion of the strap 12, such as the medial portion 16, as is shown in the drawings. The later configuration may require more material consumption and thus be more costly, but may also provide a more durable strap 12 than a strap made solely from a loop material 30.

Figure 3:
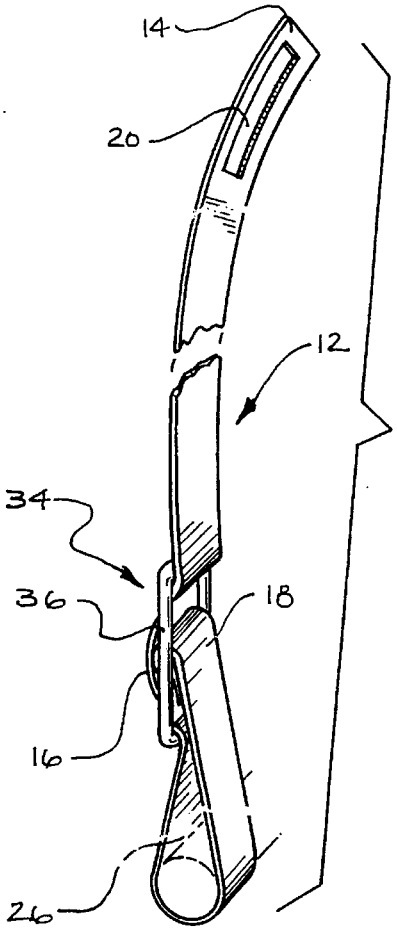
FIG. 3 is a partial perspective view of an alternative portable deadbolt lock security device.
Figure 4:
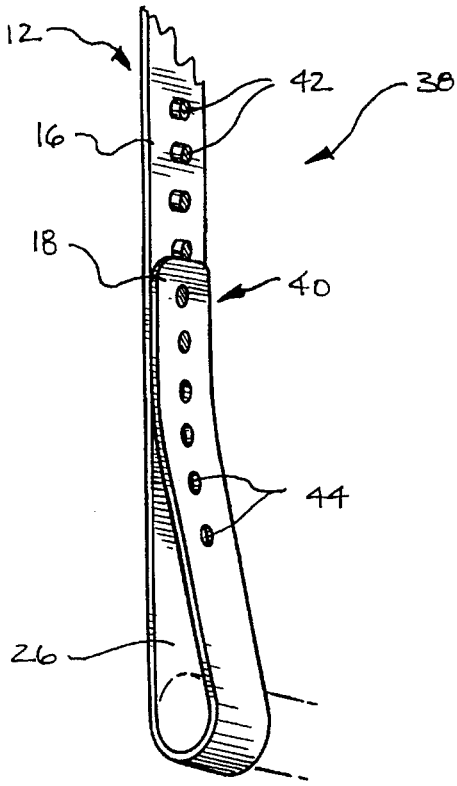
FIG. 4 is a partial perspective view of another alternative portable deadbolt lock security device.

Alternative fastening arrangements are shown in FIGS. 3 and 4. The fastener 34, as shown in FIG. 3, includes a double-D ring 36 attached to the second end 18 of the strap 12. The medial portion 16 of the strap 12 passes through the ring 36, forming a closed loop 26, and is frictionally and slidably engageable with the ring 36 to permit adjustment of the closed loop 26.

The fastener 38, as shown in FIG. 4, includes a plurality of snap fasteners 40. The snap fasteners 40 include a first element 42, such as the male element shown, and a second element 44, such as the female element shown. One of the elements 42 is attached to the second end 18 of the strap and the other element 44 is attached to the medial portion 16. To form a closed loop 26, the snap fasteners 38 are engaged with each other upon bringing the second end 18 into contact with the medial portion 16 and applying pressure to mutually aligned snap fasteners 38. Although a plurality of snap fasteners 38 are shown, a single male element 42 and a plurality of female elements 44 may be provided and vice versa.

In use and with reference to FIG. 1, the handle H of the deadbolt lock is turned to its locked position, as is shown in the drawing, and inserted into the opening 20 in the first end 16 of the strap 12. Subsequently, the strap 12 is looped about the stem of a doorknob D, pulled taut, and fastened in place, forming a closed loop 26 about the doorknob D. The tension of the tightly pulled strap 12 retains the deadbolt lock handle H in a locked position.

Although a hook and loop fastener 24 is shown adjoining the second end 18 to a medial portion 16, any one of the above mentioned fasteners 34, 38, as shown in FIGS. 3 and 4, respectively, may be employed. It should also be noted that other forms of fasteners, such as buttons and clasps (not shown), may be suitable fasteners for application in accordance with the present invention.

It is further to be understood that the present invention is not limited to the embodiments described above, but encompasses any and all embodiments within the scope of the following claims.

I claim:

1. A portable deadbolt lock security device, comprising:

a flexible strap having a first end, a second end, and a medial portion, said strap having an opening through said first end, said opening dimensioned to tightly receive a handle of a deadbolt lock; and a hook and loop fastener comprised of a hook member and a loop member, wherein a first member of said hook and loop fastener is attached to said second end of said strap and a second member of said hook and loop fastener deployed on said medial portion of said strap on the same side of said strap as said first member, said first member and said second member of said hook and loop fastener being mutually engageable to secure said second end to said medial portion of said strap; whereby, the lock security device retains the handle of the deadbolt lock in a locked position when the handle of the deadbolt lock is turned to its locked position and the strap of the device is installed by inserting the handle through the opening of the first end of the strap, looping the strap about a stem of a doorknob and pulling it taut and securing the second end of the strap to the medial portion of the strap to form a closed loop.

2. The device according to claim 1, wherein said strap is fabricated from a webbed material.

3. The device according to claim 2, wherein said webbed material is a nylon composition.

4. The device according to claim 1, wherein said strap is fabricated from a loop material, and a hook material is attached to said second end of said strap, said hook material being engageable with said loop material.

5. The device according to claim 1, wherein said opening in said strap is an elongated slot.

6. The device according to claim 1, wherein said strap is provided with reenforcement structure about said opening.

7. The device according to claim 6 wherein said reenforcement structure includes stitching about said opening.

8. The device according to claim 2, wherein said webbed material is fabricated from a man made composition.

* * * * *